US009677455B2

(12) United States Patent
Drost et al.

(10) Patent No.: US 9,677,455 B2
(45) Date of Patent: Jun. 13, 2017

(54) STACKABLE MUFFLER SHELL

(71) Applicant: Big Rapids Products, Inc., Big Rapids, MI (US)

(72) Inventors: Kurt Drost, Marne, MI (US); John J. Chaput, Rodney, MI (US)

(73) Assignee: Big Rapids Products, Inc., Big Rapids, MI (US)

( * ) Notice: Subject to any disclaimer, the term of this patent is extended or adjusted under 35 U.S.C. 154(b) by 0 days.

(21) Appl. No.: 14/802,999

(22) Filed: Jul. 17, 2015

(65) Prior Publication Data

US 2016/0017788 A1 Jan. 21, 2016

Related U.S. Application Data

(60) Provisional application No. 62/025,661, filed on Jul. 17, 2014.

(51) Int. Cl.
*F01N 13/18* (2010.01)

(52) U.S. Cl.
CPC ..... *F01N 13/1888* (2013.01); *F01N 13/1838* (2013.01); *F01N 13/1872* (2013.01)

(58) Field of Classification Search
CPC ..... F01N 13/1888; F01N 13/1838; F01N 13/1872
USPC ..... 181/282
See application file for complete search history.

(56) References Cited

U.S. PATENT DOCUMENTS 4,736,817 A 4/1988 Harwood
4,924,968 A 5/1990 Moring, III et al.
5,004,069 A 4/1991 Van Blaircum et al.
5,173,577 A 12/1992 Clegg et al.
5,229,557 A 7/1993 Allman et al.
5,252,788 A 10/1993 Emrick et al.
5,280,142 A 1/1994 Keller
5,563,383 A 10/1996 Harwood
5,597,986 A 1/1997 Harwood et al.
5,859,394 A 1/1999 Seehaus et al.
6,068,082 A 5/2000 D'Amico, Jr. et al.
6,135,237 A 10/2000 Allman
6,164,412 A 12/2000 Allman
(Continued)

FOREIGN PATENT DOCUMENTS

WO WO2010143776 A1 12/2010

OTHER PUBLICATIONS

Art Hedrick, "Cams, cams, and mare cams," www.thefabricator.com, Dec. 7, 2004, pp. 1-5, accessed on the internet on Aug. 12, 2016 at http://www.thefabricator.com/article/stamping/cams-cams-and-more-cams.

*Primary Examiner* — Jeremy Luks
(74) *Attorney, Agent, or Firm* — Reising Ethington P.C.

(57) ABSTRACT

An exhaust system component includes stacking features that prevents binding among adjacent components in a stack. The stacking features are arranged along a shell of the exhaust system component, such as along a sidewall extending from a panel of the shell. The stacking features can be arranged to define a gap between opposing surfaces of stacked shells. The stacking features can be in the form of indentations and can be formed in curved portions of the sidewall to conserve material thickness, which can be critical in exhaust system applications. The stacking features can result in a stack of components with uniform spacing among the components of the stack.

20 Claims, 5 Drawing Sheets

(56) References Cited

U.S. PATENT DOCUMENTS

| | | | | |
|---|---|---|---|---|
| 6,199,659 | B1 | 3/2001 | Allman | |
| 6,257,367 | B1 | 7/2001 | Allman | |
| 6,659,222 | B1 | 12/2003 | Allman | |
| 6,892,852 | B2 * | 5/2005 | Klein | F01N 13/1872 181/227 |
| 7,740,105 | B2 * | 6/2010 | Kimata | F01N 3/005 181/212 |
| 7,926,615 | B2 * | 4/2011 | Smatloch | F01N 1/02 181/211 |
| 2012/0192611 | A1 * | 8/2012 | Hielscher | B21D 35/006 72/200 |
| 2012/0325578 | A1 | 12/2012 | Giaume | |
| 2013/0153329 | A1 * | 6/2013 | Bischel | F01N 13/08 181/228 |

* cited by examiner

STACKABLE MUFFLER SHELL

TECHNICAL FIELD

The present disclosure relates generally to exhaust system components with features that improve material handling during manufacturing.

BACKGROUND

Exhaust system components, particularly shell or shell-like components, are typically nested or stacked together after being forming for transport to a different location in order to efficiently use the available space in a transport container. But the weight of the components in the stack, especially when combined with shifting and settling of components during transport, often causes adjacent components in the stack to become bound together. Moreover, the components often form an unstable stack that tends to lean to one side or another. These problems have existed in the exhaust system manufacturing industry for decades, causing inefficiencies in the manufacturing process due to excessive time and manpower spent separating bound together components and/or dealing with component stacks that have fallen over or that have otherwise become disorganized.

SUMMARY

In accordance with one or more embodiments, an exhaust system component includes a shell having a panel and a sidewall circumscribing the panel. The sidewall extends away from the panel to an end that defines an opening at one side of the shell. The exhaust system component includes at least one stacking feature located along the shell. Each stacking feature has a surface that contacts another identical shell when nested together with the identical shell in a stack and prevents the shell from binding with the identical shell when nested together in the stack.

In accordance with one or more embodiments, an exhaust system component includes a shell having a panel and a sidewall circumscribing the panel. The sidewall extends away from the panel to an end that defines an opening at one side of the shell. The exhaust system component includes three indentations formed in the sidewall and spaced about a perimeter of the shell. Each of the indentations has a depth perpendicular to a stacking direction sufficient to prevent any of the indentations from nesting together with corresponding indentations of another identical shell when the two shells are stacked together in the stacking direction.

In accordance with one or more embodiments, a method of making an exhaust system component includes the steps of providing a shell pre-form and forming a plurality of stacking features along the shell pre-form to obtain a shell of the exhaust system component. The shell pre-form has a panel and a sidewall circumscribing the panel and extending away from the panel to an end that defines an opening at one side of the shell pre-form. The stacking features are arranged to prevent the shell from binding with another identically formed shell when nested together in a stack with the identically formed shell.

BRIEF DESCRIPTION OF THE DRAWINGS

One or more embodiments will hereinafter be described in conjunction with the appended drawings, wherein like designations denote like elements, and wherein.

DETAILED DESCRIPTION OF EMBODIMENT(S)

The exhaust system component described below includes stacking features that improve material handling during manufacturing. One manner in which the stacking features improve material handling is by preventing stacked or nested components from sticking or binding together. Another manner in which the stacking features improve material handling is by providing a controlled and consistent depth of nesting among adjacent components in a stack, as well as uniform spacing between stacked components. The exhaust system component disclosed herein thus represents a long felt and unresolved need in the art.

Figure 1:
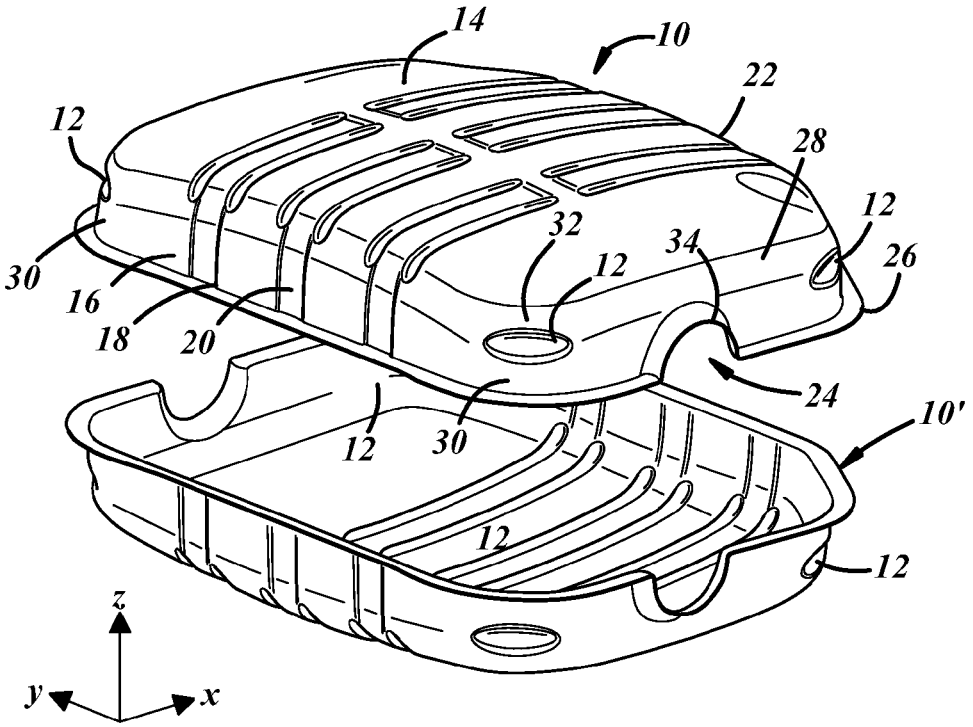
FIG. 1 is an exploded view of an exhaust system component including a shell and a plurality of stacking features.
Figure 2:
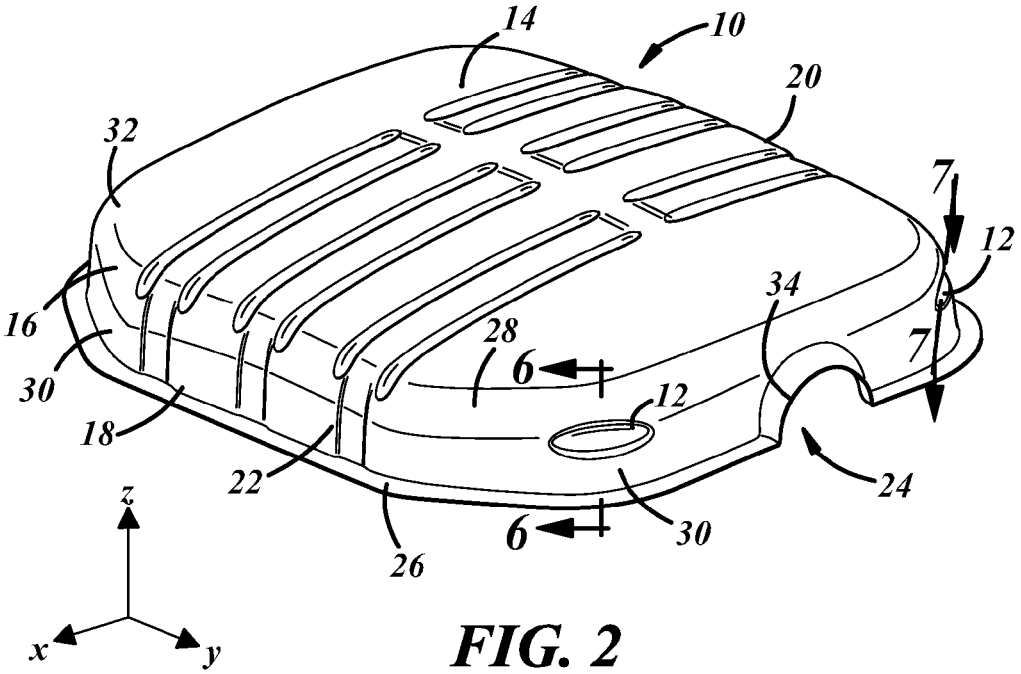
FIG. 2 is a perspective view of the shell of FIG. 1.
Figure 3:
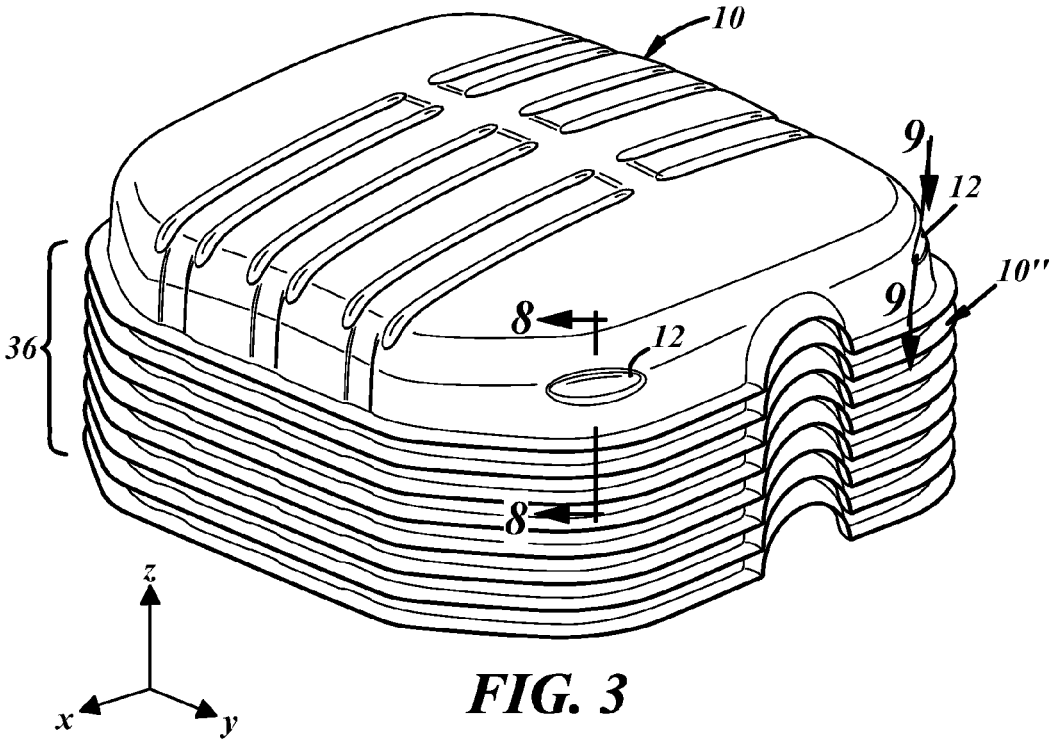
FIG. 3 is a perspective view of a stack of shells, including the shell of FIG. 2.

An embodiment of the exhaust system component 10 including stacking features 12 is illustrated in FIGS. 1-3 in the form of a muffler component for use on an automobile. The particular muffler component 10 in the figures is an outer muffler shell, though the stacking features described herein may be useful with other exhaust system components, such as internal muffler shells or components, resonator shells or components, and/or catalytic converter shells or components. Skilled artisans will recognize that the illustrated muffler shell 10 is of the general type illustrated in FIG. 1 that is assembled together with a similarly shaped muffler shell 10' to form a muffler housing with a hollow interior defined between the two shells. FIG. 1 does not illustrate any other components or materials that may be enclosed in the assembled muffler housing (e.g., baffles) in the finished muffler or exhaust system. As shown, the stacking features 12 may be included with one or both shells 10, 10', with each of the illustrated shells 10, 10' having four stacking features spaced about the perimeter of the shell. Other shell configurations (e.g., a one-piece foldable shell) may benefit from inclusion of the stacking features as well.

The illustrated shell 10 includes a panel 14 and a sidewall 16 that circumscribes and extends away from the panel to an end 18. The panel 14 extends primarily in a plane (e.g., the x-y plane in the figures), but is not necessarily flat. Likewise, the illustrated sidewall 16 extends primarily in a direction nearly perpendicular with the plane of the panel 14. In practice, the angle between the panel 14 and the sidewall 16 is typically greater than 90 degrees, as some minimum amount of draft angle may be included for manufacturing purposes. In particular, the angle between the sidewall 16 and the z-axis of a reference frame of the shell 10 is non-zero, and portions of the sidewall on opposite sides of the panel 14, such as straight portions 20, 22, are nonparallel such that each sidewall portion extends further away from the center of the panel 14 with increasing distance from the panel along the z-direction. While the illustrated sidewall 16 is near-vertical with respect to the reference frame of the shell 10, the stacking features 12 are useful with sidewalls at various angles greater than 0 degrees and less than 90 degrees with respect to the illustrated z-axis or the direction of stacking. The stacking features 12 have been found to be particularly useful at sidewall angles between 0 degrees and 60 degrees and more useful at sidewall angles between 0 degrees and 45 degrees or between 0 degrees and 30 degrees. Of course, the sidewall 16 need not be perfectly straight, and these angles represent angles measured at or near the end 18 of the sidewall.

The end 18 of the sidewall 16 defines an opening 24 at an open side of the shell 10, and the sidewall partly defines a cavity between the panel 14 and the opening 24. In this example, a flange 26 extends outwardly from the center of the shell 10 or panel 14 and away from the end 18 of the sidewall 16, circumscribing the opening 24. A transition region 28 is located between the panel 14 and the sidewall 16 and may have a different characteristic curvature (e.g., a different radius of curvature) from the panel and from the sidewall. The illustrated transition region 28 includes a radius with opposite ends that blend into the panel 14 and the sidewall 16.

The sidewall 16 includes a combination of straight portions and curved portions. In the illustrated example, the sidewall 16 includes six straight portions, including previously mentioned opposite straight portions 20, 22, as well as six curved portions 30 (only some of which are labeled in the figures). As used here, "straight" and "curved" refer to the shape of the sidewall 16 with respect to a plane parallel with the illustrated x-y plane. Each one of the curved portions 30 in the illustrated embodiment extends between a different pair of straight portions. Any curved portion 30 of the sidewall 16 that extends between two straight portions may also be referred to as a corner of the sidewall. Corner transition regions 32 may be present where the transition region 28 is adjacent to or overlaps with a corner 30. The shell 10 may also include one or more cutouts 34 in the sidewall 16 to accommodate attachment of the finished muffler to exhaust inlet and outlet conduits. In this example, two cutouts 34 are located along the sidewall 16 at opposite ends of the shell 10, but they could be located anywhere along the sidewall.

The shell 10 includes a plurality of stacking features 12 configured to prevent the shell from sticking or binding to another shell when the shells are stacked together in a nested manner to form a stack 36, as shown in FIG. 3. More particularly, the stacking features 12 are configured to prevent the shell from sticking to an adjacent shell 10" in the stack 36. Exemplary stacking feature configurations and functions are described further below. Each shell in the stack 36 of FIG. 3 is substantially identical to one another and to the shell 10 of FIG. 2.

The illustrated shell 10 includes four stacking features 12 spaced about the perimeter of the shell. Two of the four stacking features 12 are visible in FIGS. 2 and 3 and are illustrated from the outside of the shell 10. Preferably, the shell 10 includes three or more stacking features 12 to define a plane where the stacking features 16 contact an adjacent shell 10" of the stack 36 as described further below. In the illustrated embodiment, the stacking features 12 are formed along the sidewall 16 of the shell 10—i.e., away from the panel 14. The illustrated stacking features 12 are also formed along the transition region 28 between the panel 14 and the sidewall 16 and, more particularly, along a sidewall end of the transition region 28. Also, each of the illustrated stacking features 12 is located at a curved portion or corner 30 of the sidewall 16. One or more stacking features 12 may be formed elsewhere along the sidewall 16 between the panel 14 and end 18 and/or along a straight portion of the sidewall.

The illustrated stacking features 12 are integrated features of the shell 10, which is to say that the shell is formed from a single piece of sheet metal or metal laminate (e.g., steel) with the stacking features 12 in the form of indentations formed in the sheet metal. The indentations in the figures are formed with the concave side of the indentation on the outside of the shell 10. Other embodiments may include indentations formed with the concave side on the inside of the shell 10. Although there are certain advantages to integrally forming the stacking features, it is also possible to make the shell 10 with separately attached stacking features, such as a bead of material or properly configured and attached ribs or gussets.

Figure 4:
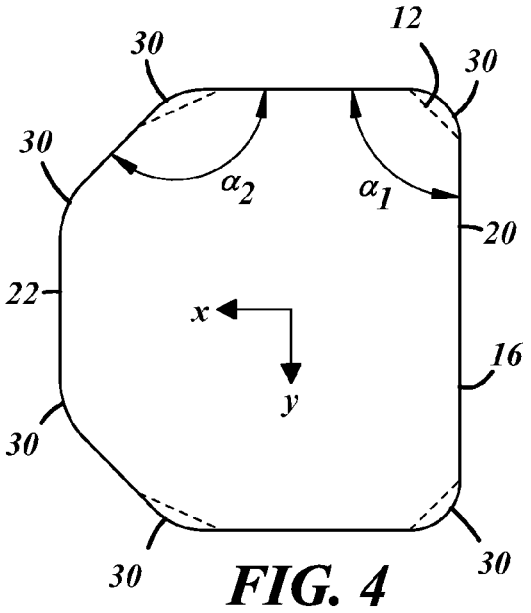
FIG. 4 is a profile of the sidewall of the shell of FIGS. 2 and 3.

Although the stacking features 12 need not necessarily be formed along curved portions or corners 30 of the sidewall 16, there are certain subsequently discussed benefits to forming one or more of the stacking features at a corner. FIG. 4 schematically represents a profile of the sidewall 16 of the shell 10 of FIGS. 2 and 3 as traced along a plane parallel with the x-y plane. The stacking features 12 are represented by dashed lines. The illustrated corners 30 are curved portions of the sidewall 16 that extend between and interconnect straight portions of the sidewall. The angle $\alpha_1$ represents the angle between two straight portions of the sidewall 16 that are substantially perpendicular with each other. The angle $\alpha_2$ represents the angle between a different pair of straight portions of the sidewall 16, where $\alpha_2$ is greater than 90 degrees. It is preferable that the included angle ($\alpha_1$ or $\alpha_2$) between the interconnected straight portions of the sidewall 16 is in a range from 90 degrees to 150 degrees or, more preferably, in a range from 90 degrees to 135 degrees or 90 degrees to 120 degrees.

Figure 5:
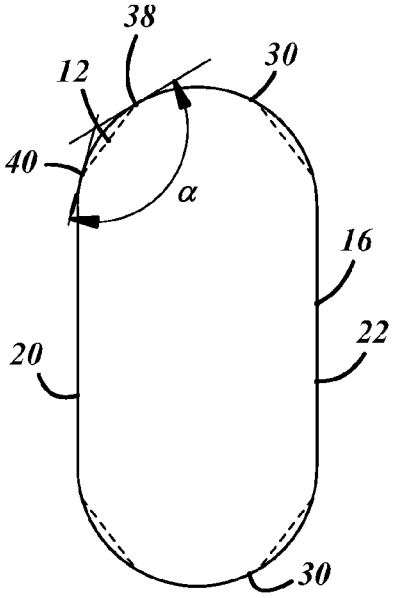
FIG. 5 is a profile of the sidewall of a different shell.

FIG. 5 schematically represents a different example of a profile of the sidewall 16 of the shell 10. This profile is oblong and includes only two parallel straight portions 20, 22 and two curved portions 30 interconnecting the straight portions. In this example, the stacking features 12 are formed along the curved portions 30 of the sidewall 16, but do not necessarily extend the entire length of the curved portion or entirely between straight portions as in FIG. 4. However, an included angle $\alpha$ can still be determined between tangents of the curved portion located at opposite ends 38, 40 of each stacking feature, as shown. The stacking features 12 are preferably formed at locations along the sidewall where the included angle ($\alpha$ or $\alpha_1$ or $\alpha_2$) is in a range from 90 degrees to 150 degrees or, more preferably, in a range from 90 degrees to 135 degrees or 90 degrees to 120 degrees.

Corners or curved portions 30 with the above-described characteristics can be ideal locations for the stacking features 12 in some instances. For example, in a process where the stacking features 12 are formed into a shell pre-form, in which the panel 14 and sidewall 16 of the shell have already been formed, the material at the corners 30 of the pre-form may be thicker than the material away from the corners, which may have been elongated or thinned to a greater degree in the pre-form operation. This may be important for a number of reasons. For instance, the less-thinned material at the corners of the pre-form is a low elongation region that has the potential for forming more defined or deeper stacking features 12 than other material of the shell pre-form that has already been thinned to a greater degree. In addition, in exhaust system applications, material thickness can be a critical factor affecting the function of the component. For example, material thickness may correlate to sound attenuation in a muffler. Some muffler manufacturers set limits on the minimum thickness of the finished component. In some cases, the maximum allowable amount of thinning through the shell forming process is 20% or less.

Figure 6:
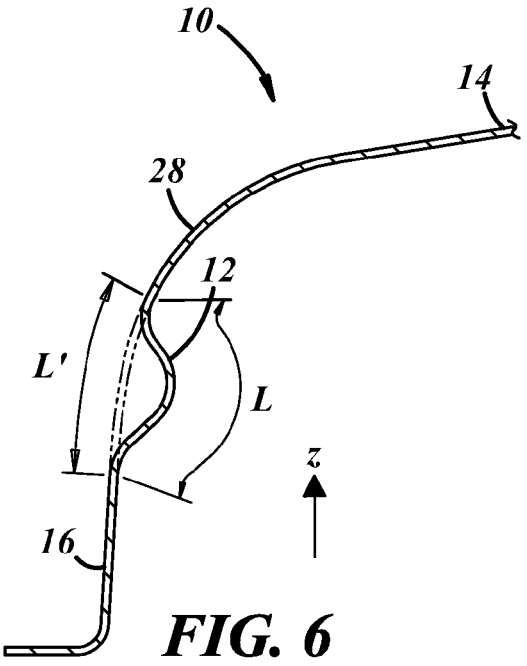
FIG. 6 is a cross-sectional view of a stacking feature of FIG. 2.

Corner-formed stacking features 12 also have the advantage of minimizing additional material thinning during stacking feature formation. FIG. 6 is a partial cross-sectional view of the shell 10 of FIG. 2 taken along a plane parallel with the z-axis at the lengthwise mid-point of one of the stacking features 12. The portion of FIG. 6 in phantom represents the shape of the shell 10 before the stacking feature 12 is formed. As shown, the length L as measured along the contour of the stacking feature is greater than the pre-form length L' between the same two points. In other words, formation of the stacking feature 12 elongates the shell material in a direction along the length (i.e., between panel 14 and end 18) of the sidewall 16 (L>L'). This would hold true for the stacking feature 12 if formed anywhere along the sidewall 16, whether at a straight or curved portion.

Figure 7:
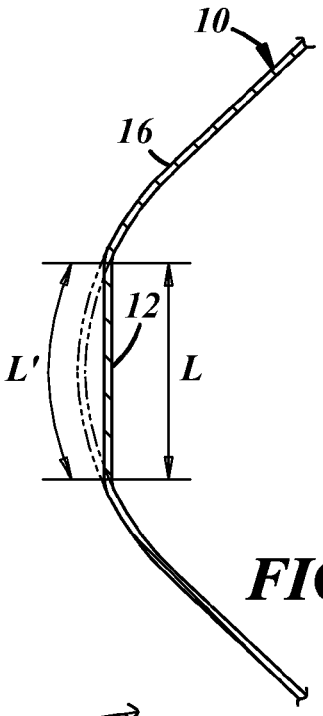
FIG. 7 is a cross-sectional view along the length of a stacking feature of FIG. 2.

FIG. 7 is a partial cross-sectional view of the shell 10 of FIG. 2 taken along a plane parallel with the x-y plane at the radial mid-point of one of the stacking features 12. The portion of FIG. 7 in phantom represents the shape of the shell 10 before the stacking feature 12 is formed. As shown, the length L as measured along the contour of the stacking feature, which is generally flat or straight in this example, is less than the pre-form length L' between the same two points. In other words, formation of the stacking feature 12 compresses the shell material in a direction along the length of the stacking feature (L<L'). This only holds true where the indentation-type stacking feature 12 is formed along a curved portion of the sidewall 16, with the magnitude of the compression increasing with a decreasing included angle $\alpha$ as described above. The combined effect of elongation in one direction and compression in a perpendicular direction is conservation of material thickness at the stacking feature 12. As noted above, material thickness and, in particular, limited thinning of the material during forming operations can be critical in exhaust system applications. Conserving material thickness is thus one advantage of forming the stacking features at curved portions 30 of the sidewall 16.

Another benefit associated with forming the stacking features 12 at curved portions 30 of the shell 10 is the overall integrity of the shell at these locations. The relatively tight curvature at shell corners 30 provides the shell with increased rigidity in some directions, which aids stacking feature function, particularly in a large stack of components where the load on the bottom components of the stack can become quite high. The rigidity at the shell corners 30 can help limit shell flexibility that may occur in less rigid portions of the shell 10, such as the straight portions of the sidewall 16.

Figure 8:
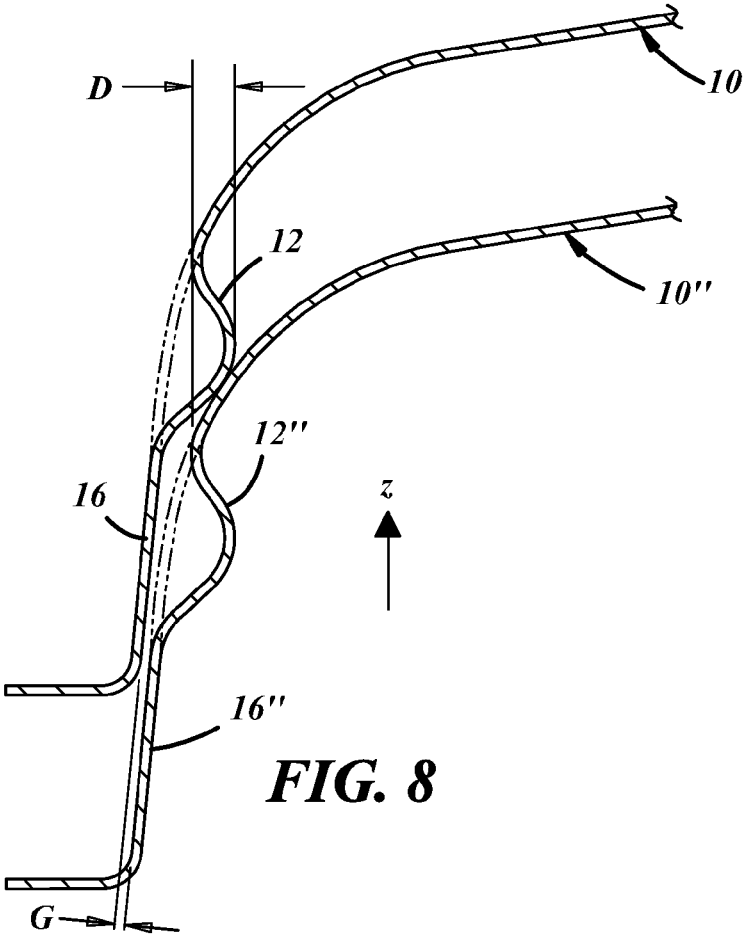
FIG. 8 is a cross-sectional view of stacking features of the stack of FIG. 3.

A cross-sectional view taken through the stacking features 12, 12" of shells 10, 10" is shown in FIG. 8, with the profile of the sidewall 16 away from the stacking feature 12 shown in phantom. As illustrated in FIG. 8, the stacking features 12 may be configured to prevent portions of the sidewalls 16, 16" of the shells 10, 10" from touching when stacked together. Different combinations of stacking feature depth and location along the sidewall 16 can be used to arrive at such a configuration. The inventors have determined that when adjacent components in a stack of exhaust system components stick or become bound together, it is due at least in part to excessive contact between the sidewalls of the adjacent components. Stamped components such as muffler shells become bound together when the outside of one component becomes wedged into the inside of another identical component. Providing stacking features that prevent this wedging from occurring thus prevents the binding problem. The stacking features 12 also prevent corresponding panels and transition regions of adjacent shells from touching.

In the illustrated example, this stacking feature function is provided by locating the stacking features 12 along the sidewall 16 of the shell 10 such that the adjacent shell 10", the outside of which is placed in the interior of the shell 10, cannot fully nest with the shell 10, thus preventing sidewall-to-sidewall contact and/or surface-to-surface contact between the shells. In other words, the only points of contact between adjacent shells 10, 10" are at the stacking features 12 and, in particular, where the convex side of the stacking features 12 contact the outside of the adjacent shell 10". A gap G is thus present between opposing surfaces of adjacent shells 10, 10" when stacked. The gap G is defined at the minimum distance between opposing shell surfaces in the stack. The gap G is greater than zero and, while there is no theoretical upper limit, a gap between 0.5 mm and 1.5 mm has been found to be effective in shell stacks in practice. The optimum gap G may vary depending on the number of shells in the stack (i.e., a larger number of shells may require a larger gap G). Of course, the shell density or number of shells in the stack per unit length in the z-direction increases with a decreasing gap size. An optimum gap size (maximized shell density without shell-to-shell binding) can be determined by decreasing the gap G until adjacent shells in the stack begin to bind together and specifying the gap at a dimension slightly higher. A gap G of about 1 mm is sufficient in some embodiments.

Another dimension useful to control is the amount of overlap D between the stacking features 12, 12" of adjacent shells in the stack. Overlap D is measured, as shown, from the convex side of the stacking feature 12 (at the point furthest inward with respect to the panel 14) to the sidewall 16" of the adjacent shell 10" at the beginning of stacking feature 12" of the adjacent shell. A minimum amount of overlap D is necessary to prevent the stacking features 12, 12" of adjacent shells from becoming interlocked, for example if the top shell is slightly tilted while being placed into the stack. In other words, the stacking features must have a depth in the x- and/or y-direction that is sufficient to prevent the convex side of one stacking feature 12 from ever being able to become nested together with the concave side of another stacking feature 12", no matter how much the shell being placed onto the stack is tilted with respect to the x-y plane. In some embodiments, an amount of overlap D in a range from 5 mm to 10 mm is sufficient, and an amount of overlap D in a range from 6 mm to 8 mm is preferable.

In some embodiments, the stacking features 12 are located along the sidewall 16 away from the end 18 of the sidewall, as shown. In the illustrated example, the stacking feature 12 is located along the portion of the sidewall 16 nearest the transition region 28 and nearest the panel 14. This can help maximize the extent of nesting of adjacent components, enhancing the stability of the stacked components and packaging efficiency (i.e., minimizing the gap G) while still preventing sidewall contact. For instance, if the stacking features 12 are located at or too close to the end 18 of the sidewall 16, the stability of the stacked components, and the spatial efficiency, may be compromised. Preferably the stacking features 12 are configured so that the center of gravity of the top shell in a pair of adjacent shells of the stack is located in the interior of the bottom shell of the pair.

Figure 9:
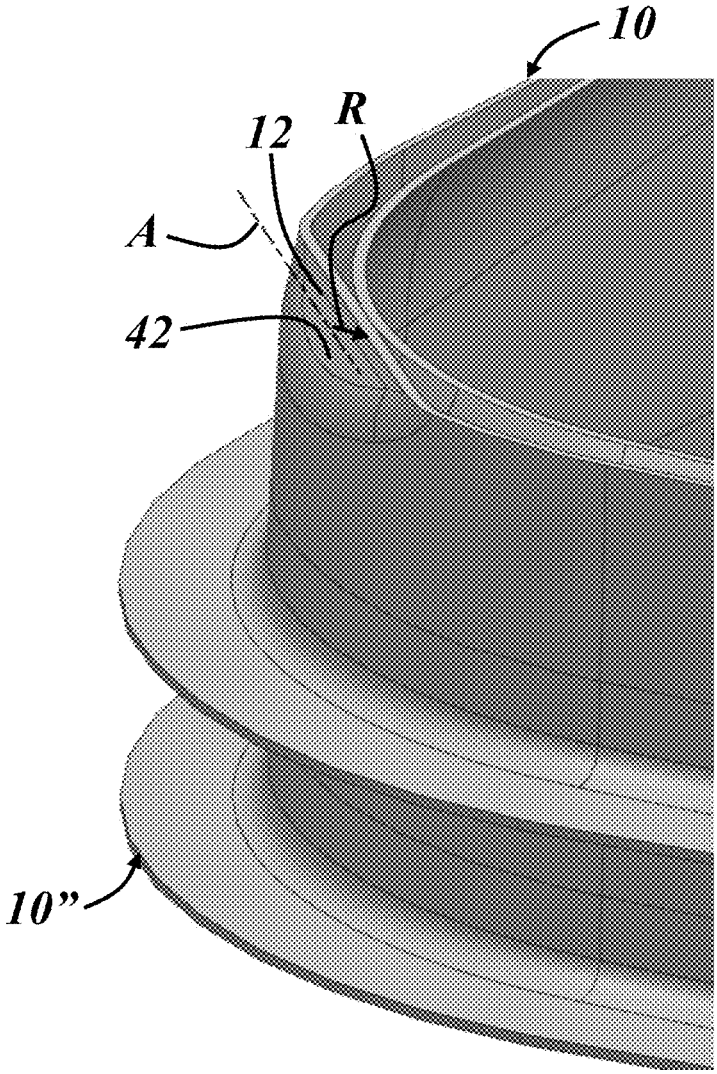
FIG. 9 is a cutaway view along the length of a stacking feature of the stack of FIG. 3.

FIG. 9 is a partial cross-sectional view of the stack 36 of FIG. 3. As shown, each stacking feature 12 may comprise a concave surface 42 that follows the shape of a cylinder having a radius R and a central axis A. In other embodiments, the central axis A may be curvilinear with a constant radius R. In still other embodiments, the radius R varies along the length of the stacking feature 12 and/or the surface 42 may include planar (i.e., non-contoured) portions. In some embodiments, the radius R is in a range from 4 mm to 8 mm and, preferably, is in a range from 5 mm to 7 mm or is about 6 mm.

The above-described exhaust system components are typically metal components (e.g., steel or stainless steel), and the stacking features 12 can be formed via conventional metal forming techniques. In the examples described above, a cam-forming operation with tool support at the interior side of the shells 10 can be used to form the stacking features 12. However, skilled artisans in possession of this disclosure may devise other techniques or use other materials to realize the benefits of the teachings presented herein.

Figure 10:
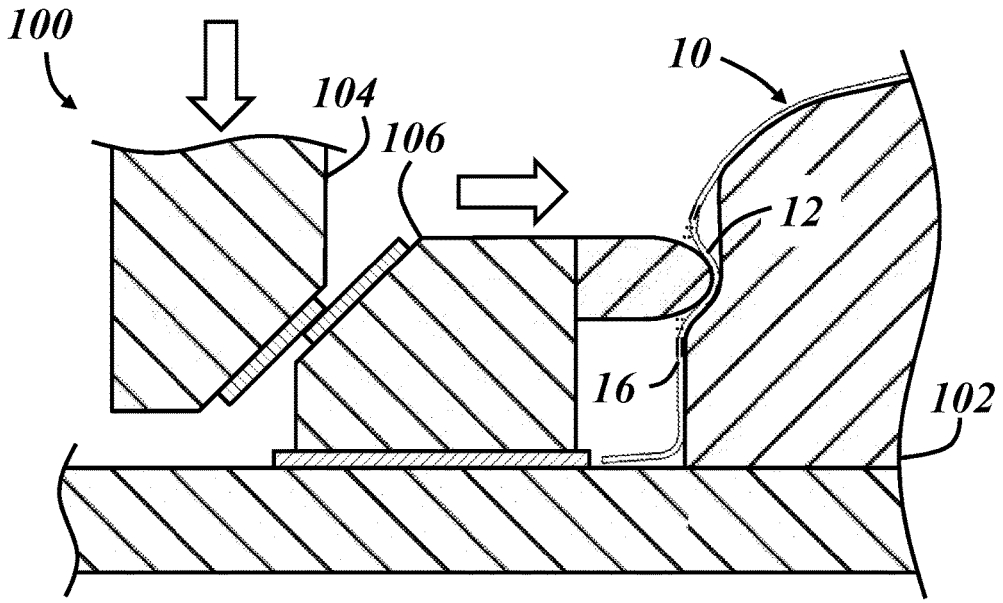
FIGS. 10 and 11 schematically illustrate an exemplary cam-forming operation.
Figure 11:
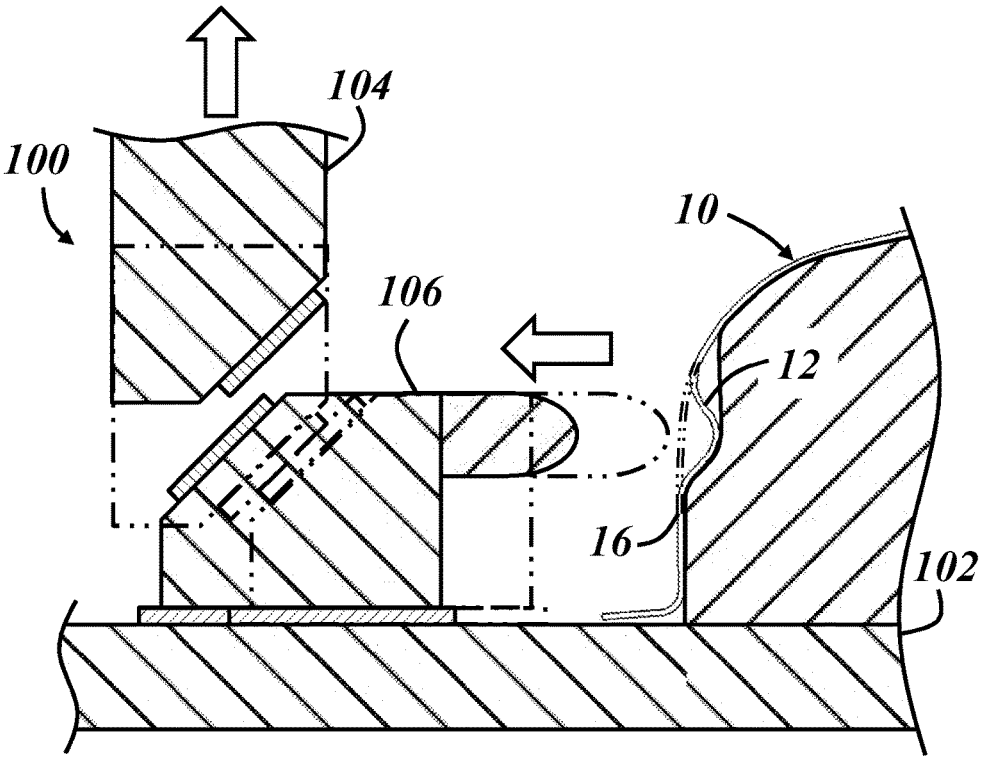

FIGS. 10 and 11 schematically illustrate an exemplary cam-forming operation forming a stacking feature 12 into the sidewall 16 of a shell pre-form to form a shell 10. Portions of a forming tool 100 are illustrated, included a first or bottom die half 102, an a second or top die half 104 that moves vertically with respect to the bottom die half. The bottom die half 102 includes a cam or slide 106 that moves against a bias (e.g., a die spring) toward the part to be formed when the top die half 104 moves toward it and contacts it. FIG. 10 shows the slide 106 forming the stacking feature 12 with the top die half 104 in a closed position of the tool 100, and FIG. 11 shows the slide 106 retracted away from the formed shell with the top die half moved toward an open position of the tool. The cam-forming operation is thus configured to form features into a component from a direction other than the die-draw direction (which is vertical in this example), such as in a horizontal or other non-vertical direction.

It is to be understood that the foregoing is a description of one or more preferred exemplary embodiments of the invention. The invention is not limited to the particular embodiment(s) disclosed herein. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. An exhaust system component, comprising:

a shell having a panel and a sidewall circumscribing the panel and extending away from the panel to an end that defines an opening at one side of the shell; and at least one stacking feature located along the shell, each stacking feature having a surface that contacts another identical shell when nested together with the identical shell in a stack and prevents the shell from binding with the identical shell when nested together in the stack, wherein each stacking feature is an integrally formed indentation formed along the sidewall of the shell from the same sheet of material as the shell.

2. An exhaust system component as defined in claim 1, comprising a plurality of stacking features spaced about a perimeter of the shell, wherein at least one of the stacking features is formed at a curved portion of the sidewall.

3. An exhaust system component as defined in claim 1, wherein the at least one stacking feature is configured to prevent sidewalls of the stacked shells from touching each other.

4. An exhaust system component as defined in claim 1, wherein the at least one stacking feature is configured such that a portion of the identical shell is located in an interior of the shell between the panel and the opening when the shells are stacked together.

5. An exhaust system component as defined in claim 1, wherein each stacking feature comprises a portion of a cylindrical surface.

6. A muffler assembly comprising the exhaust system component of claim 1, wherein the shell is attached to another different shell to form a housing of the muffler assembly with a hollow interior defined between the shell and said another different shell.

7. An exhaust system component, comprising:

a shell having a panel that extends primarily in an x-y plane and a sidewall circumscribing the panel and extending away from the panel to an end that defines an opening at one side of the shell, the opening being spaced from the panel in a stacking direction that is perpendicular to the x-y plane; and three indentations formed in the sidewall and spaced about a perimeter of the shell, wherein each of the indentations has a depth perpendicular to the stacking direction sufficient to prevent any of the indentations from nesting together with corresponding indentations of another identical shell when the two shells are stacked together in the stacking direction, wherein at least one of the indentations has a central axis oriented perpendicular to the stacking direction, the central axis extending in a plane located between the x-y plane and the end of the sidewall.

8. An exhaust system component as defined in claim 7, wherein each indentation is integrally formed from the same sheet of material as the shell.

9. An exhaust system component as defined in claim 7, wherein each indentation has a convex side facing toward an interior of the shell.

10. An exhaust system component as defined in claim 7, wherein each indentation contacts the identical shell when stacked together such that a gap is defined between opposing surfaces of the shell and the identical shell with the two shells being in contact only at the indentations.

11. An exhaust system component as defined in claim 7, wherein at least one of the indentations is formed in a curved portion of the sidewall having an including angle in a range from 90 degrees to 150 degrees.

12. A stack of exhaust system components, comprising at least three exhaust system components as defined in claim 7 stacked together, wherein a gap is defined between opposing surfaces of each pair of components in the stack, and each gap is the same such that the spacing among the exhaust system components of the stack is uniform in the stacking direction.

13. A muffler assembly comprising the exhaust system component of claim 7, wherein the shell is attached to another different shell to form a housing of the muffler assembly with a hollow interior defined between the shell and said another different shell.

14. A method of making an exhaust system component, comprising the steps of:

providing a shell pre-form having a panel and a sidewall circumscribing the panel and extending away from the panel to an end that defines an opening at one side of the shell pre-form; and forming a plurality of stacking features along the shell pre-form to obtain a shell of the exhaust system component, the stacking features being arranged to prevent the shell from binding with another identically formed shell when nested together in a stack with the identically formed shell, wherein the stacking features are formed only along the sidewall during the step of forming such that the shape of said panel is the same before and after the step of forming.

15. The method of claim 14, wherein the step of forming includes forming indentations along the shell pre-form such that the shell pre-form is elongated in one direction and compressed in another different direction at one or more of the indentations.

16. The method of claim 14, wherein the step of forming includes forming an indentation having a surface that lies along a cylinder.

17. The method of claim 14, further comprising:

repeating the steps of providing and forming to obtain a plurality of shells including at least three shells; and stacking the plurality of shells together to obtain a stack of shells with uniform spacing among the plurality of shells in a stacking direction.

18. The method of claim 14, wherein the stacking features are formed in a cam operation.

19. The method of claim 14, wherein the shell pre-form is formed from a layer of sheet metal and each stacking feature is integrally formed from the same sheet of material as the shell pre-form.

20. The method of claim 14, wherein at least one of the stacking features has a central axis oriented perpendicular to a stacking direction, the central axis extending in a plane located between the panel and the end of the sidewall.

* * * * *